US005901902A

United States Patent [19]

Grabher

[11] Patent Number: 5,901,902

[45] Date of Patent: May 11, 1999

[54] DISPENSING BOX

[76] Inventor: Werner Grabher, Oberwingerstrasse 8, CH-9436 Balgach, Switzerland

[21] Appl. No.: 08/879,057

[22] Filed: Jun. 19, 1997

[30] Foreign Application Priority Data

Jun. 20, 1996 [EP] European Pat. Off. ..... 96110000

[51] Int. Cl.[6] ..... B65D 3/10

[52] U.S. Cl. ..... 229/5.5; 229/93; 229/4.5; 222/548; 222/480; 220/621

[58] Field of Search ..... 220/256, 780, 220/709.1, 601, 612, 614, 613, 626, 804, 615, 621; 222/548, 480; 229/5.5, 93, 4.5

[56] References Cited

U.S. PATENT DOCUMENTS

| | | | |
|---|---|---|---|
| 1,208,483 | 12/1916 | Chesbrough | 229/125.05 X |
| 2,120,898 | 6/1938 | Moore | 229/125.05 X |
| 2,150,308 | 3/1939 | Annen | 229/125.05 |
| 2,493,086 | 1/1950 | Reifsnyder | 229/5.5 |
| 2,505,748 | 5/1950 | Barbieri | 229/5.5 |
| 3,377,014 | 4/1968 | Rocher | 229/5.5 |
| 3,402,874 | 9/1968 | Sternau | 229/125.05 X |
| 4,154,360 | 5/1979 | Smith | 229/125.05 X |
| 4,852,793 | 8/1989 | Homma et al. | 229/5.5 |
| 5,407,107 | 4/1995 | Smith | 222/548 |

*Primary Examiner*—Gary E. Elkins
*Assistant Examiner*—Tri M. Mai
*Attorney, Agent, or Firm*—Rothwell, Figg, Ernst & Kurz

[57] ABSTRACT

The dispensing box comprises a cylinder (2, 11*a*) around a box axis (A), essentially comprising cardboard or paper, which is closed at the end by a closure element which is formed as a dispensing membrane (4*a*, 12) and essentially comprises cardboard or paper. Only a collar-like contact surface of the closure element is connected to a contact surface of the cylinder (2, 11*a*). The inside of the closure surface of the lid (3, 13) can be placed against the outer surface of the dispensing membrane (4*a*, 12). In a preferred embodiment, the lid (13) is connected to the dispensing box by means of a snap connection, rotatably about the box axis (A). For this purpose, a first projection (12*b*) overlapping the box cylinder (11*a*) on the outside is provided at the upper box edge and a second projection (13*b*) projecting inward is provided on the inside of the collar (13*a*) of the lid (13). In the snapped-in state, a locking surface (12*c*) of the first projection (12*b*) rests against a locking surface (13*c*) of the second projection (13*b*). At least one of the projections (12*b*) is in the form of a locking lip projecting from the box cylinder (11*a*) or from the lid collar (13*a*) and the other projection is preferably in the form of a cardboard ring (13*b*) connected to the box cylinder (11*a*) or to the lid collar (13*a*).

6 Claims, 3 Drawing Sheets

DISPENSING BOX

Dispensing boxes having a box cylinder of sheet metal or glass and a plastics closure provided with dispensing openings are widely used in the household. It is desired to be able to close and open the one or more dispensing openings or to be able to open different groups of dispensing openings alternately. Inverted lids or two-layer lids whose two layers are rotatable relative to one another are used for this purpose.

CH 597 806 has disclosed a box which comprises a plastics dispensing membrane inserted into a box and plastics lid inverted over the box. To hold the inverted lid rotatably on the box, an outward-projecting bead is provided in the box cylinder and a matching groove is provided in the lid—which, owing to its (plastic) elasticity, can be inverted over the upper edge of the dispensing box.

The conventional dispensing boxes are generally used as packaging which is disposed of after its intended use. In order to permit simple and economical recycling, the dispensing boxes should as far as possible be formed wholly from only a single, readily recyclable material, plastic being undesirable because disposal charges have to be paid for it. On the other hand, cardboard boxes are capable of rotting and give rise to no disposal charges. Since thin coatings of aluminum or metal and/or plastic do not lead to intolerably high proportions of foreign materials, such coatings are provided in accordance with the respective requirements. However, the stability-imparting layer consists in each case of cardboard or paper.

For example, closure elements which are arranged in the interior of the box, transversely with respect to the box axis, and provided with outlet openings serve as dispensing membranes for metering out the box content. A lid which can be inserted into the box must be used for tightly closing the outlet openings. Functional, insertable lids are made of plastic. Not only is the use of a further material a disadvantage, but also the fact that the distance of the dispensing membrane from the cylinder end must agree exactly with the lid depth. Moreover, residues of the dispensed material tend to collect in the all-round inner edge of the closure membrane, outside the Interior of the box.

Cardboard lids which essentially correspond in shape to the known insertable plastics lids have already been produced. However, these insertable cardboard lids are expensive to produce and furthermore cannot guarantee exact contact with a dispensing membrane arranged in the interior of the box, at least not if a lid connecting line is to be closely adjacent to the cylinder end edge.

It is the object of the Invention to provide a dispensing box of—optionally coated—cardboard or paper. This object is achieved by the realization of the features in the preamble, together with the characterizing features of claim 1. Preferred embodiments of the invention are described in the characterizing clauses of the dependent claims.

To provide a dispensing box according to the invention, a cardboard cylinder around a box axis or a cylinder of paper is closed with a cardboard or paper closure element whose closure surface is essentially in the plane terminating the cylinder at the end. Only a collar-like contact surface of the closure element is connected to a contact surface of the cylinder. The box cross-section may be of any desired form but is preferably circular. To enable the closure element to be used as a dispensing membrane, it must have at least one outlet opening. Dispensed material can be prevented from collecting on the outside of the dispensing membrane by means of the box closure which is flush with the end and has a closure element or a dispensing membrane. A box having such a dispensing membrane can readily be tightly closed by means of the cardboard or paper lid which is invertable over the box and preferably comprises a lid cylinder and a closure element arranged on the end. The inner surface of the lid must be adapted to the outer surface of the box.

The contact surface of the closure element is adjacent to a contact surface on either the outside or the inside of the box cylinder.

In order to achieve essentially cylindrical connection regions or contact surfaces connected to one another, a press apparatus having at least one radially adjustable press surface is provided, said press surface being capable of being pressed against the contact surfaces after the Introduction of the latter. During pressing from the inside, at least one press part, but preferably a plurality of press parts, having a convex press surface, must be capable of being moved from a feed position with a smaller press surface circumference to a pressing position having a larger circumference. During pressing from the outside, at least one press part, but preferably a plurality of press parts, having a concave press surface, must be capable of being moved from a feed position with a larger press surface circumference to a pressing position with a smaller circumference. The parts capable of being moved from the outside into the pressing position may be dimensioned in such a way that they form a step-free closed circumferential line when resting against one another.

During pressing of a collar resting against the outside of a cylinder, pressing is preferably carried out in such a way that the outer surface of the collar is flush with the non-deformed outer surface of the cylinder.

In order, if required, to hold the inverted lid rotatably on the box, a snap connection comprising a snap element, in particular a locking lip, is provided between the lid and the dispensing membrane or its collar.

The locking lip can be mounted on the collar of the box membrane (outside) or of the lid (inside). However, both lid and box may of course each be provided with an inner and outer locking lip, respectively, both of which then interlock with one another after the lid has been mounted. In any cue, it is sufficient to mount the lid on the box by means of the essentially freely movable locking lip in order to snap the lip onto the respective other snap surface and hence to bring about a connection which can no longer be detached without destruction. In other words, a type of snap closure is formed.

However, the other projection in each case may also be in the form of a cardboard ring or roll ring, imparting better rigidity to the box cylinder or to the lid. The wall thickness of the locking lip is preferably smaller than the radial dimension of the cardboard ring or roll ring coordinated with it, in order to ensure a secure snap connection.

Both projections expediently extend over the total circumference in each case; however, the lid is then virtually no longer removable without destroying the dispensing membrane or the entire box. If it Is intended to design the lid for removal and replacement, the projections must be provided with interruptions corresponding to one another. However, a more rigid box and lid material will have to be chosen in this case since the interrupted cardboard ring or roll ring can no longer provide the rigidity mentioned.

Application of the locking lip at least to the box membrane is particularly advantageous since said membrane generally has a thinner wall and therefore has a certain elasticity after thermoforming (compression) of the collar and also offers more possibilities in terms of production.

Further details of the invention are evident from the following description of embodiments illustrated in the drawing.

Figure 1:
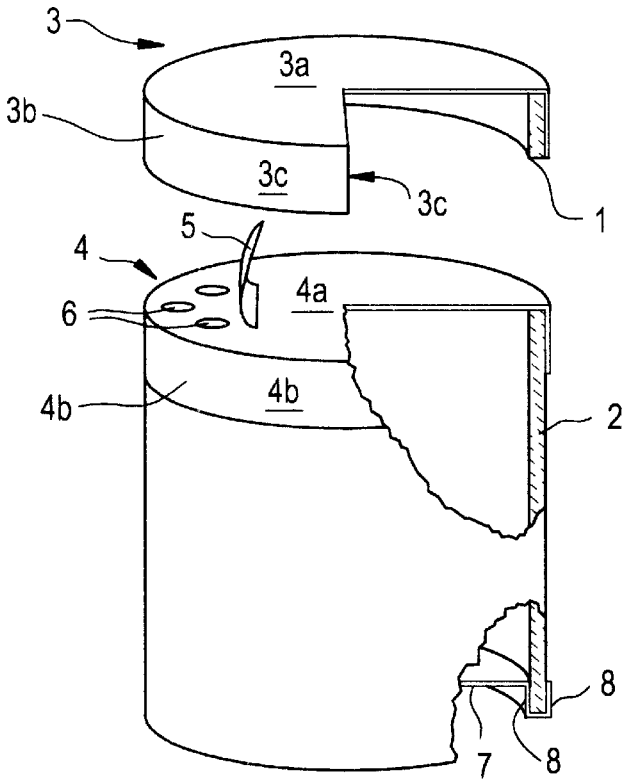
FIG. 1 shows the perspective, partly cut away view of a dispensing box according to the invention, having a mountable and removable lid.

According to FIG. 1, a box according to the invention comprises at least one closure element 4 which is arranged in the plane of the box closure and whose closure surface 4*a* is in the form of a dispensing membrane having at least one outlet hole 6 which is optionally closed by a removable protective surface 5. The closure surface, according to the invention, of the all-round, annular collar 4*b* of the closure element 4 is optionally in the form of an at least partly removable protective membrane. The closure surface 4*a* or dispensing membrane is connected via its first contact surface 4*c* to the cylinder 2 of the box, this being effected by means of a second contact surface 2*c* of the cylinder 2. The two contact surfaces 2*c* and 4*c* are preferably connected to one another by heat sealing, a press apparatus used for this purpose, known per se and therefore not shown pressing against the collar 4*b*, preferably only from the outside, in particular so that its outer surface is flush with the outer surface of the non-deformed cylinder.

In the embodiment shown, the box base 5 is in the form of a cardboard tube closure according to the prior art. The base surface 7 is present in the interior of the box, and two connecting surfaces 8 are connected to the cylinder end. In order to press the two connecting surfaces 8 against the cylinder 2, the press apparatus must have at least two press surfaces.

Shown above the box is a lid 3 which is in the form of a tube closure and, for this purpose, comprises a lid cylinder 1 and a closure element having a lid closure surface 3*a* flush with a cylinder end face and a collar 3*b* adjacent to the cylinder 1, and said lid may rest against the lid cylinder 1 preferably on the outside but optionally also on the inside. The internal diameter of the lid cylinder 1 is adapted to the external diameter of the box. The lid cylinder 1 imparts to the lid 3 stability which ensures a firm fit of the lid 3 on the box even after many removal and replacement cycles.

Figures 2A, 2B, 2C:
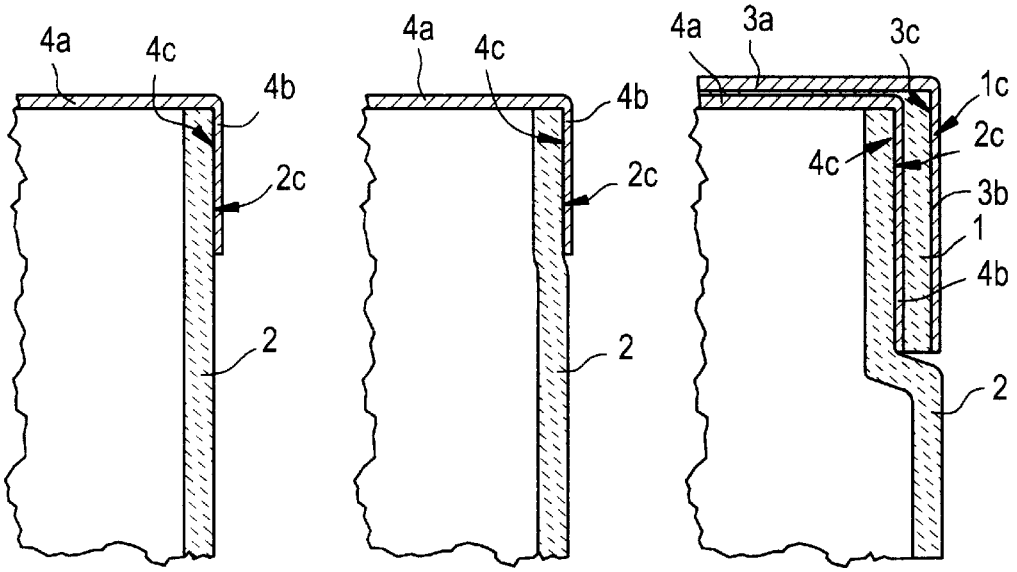
FIG. 2 to 6 show various embodiments, each in a section in the axial direction through a dispensing box according to the invention.

FIG. 2 shows various shapes in the connection region of the first and of the second contact surfaces 2*c* and 4*c* or 1*e* and 3*c*. Example a) envisages that the contact surface 4*c* of the membrane collar 4*b* rests against the non-deformed box cylinder 2 and thus projects slightly from the cylinder surface. In order to ensure an equal external radius along the entire box axis, as shown in Example b), the box contact surface 2*c* is compressed slightly radially inward during pressing of the membrane collar 4*b*, so that its outer surface is flush with the outer surface of the box cylinder 2. Example c) shows an embodiment in which the compression of the box contact surface 2*c* was carried out in such a way that the outer surface of a mounted lid 3 connects flush with the outer surface of the box cylinder 2.

Figure 3:
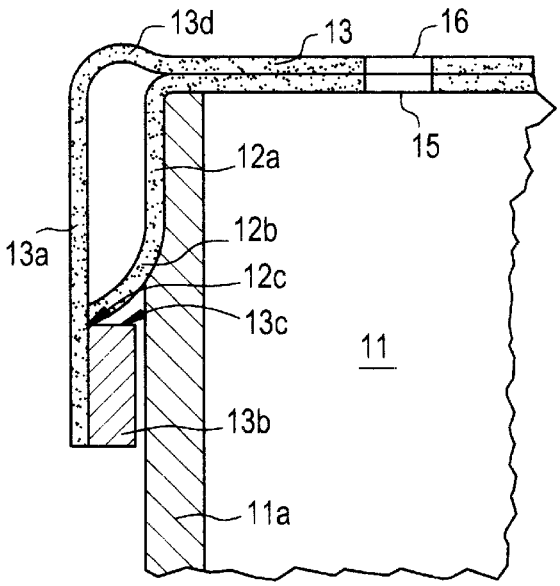

According to FIG. 3. a dispensing box 11 according to the invention comprises at least one closure surface which is arranged in the plane of the box closure and is in the form of dispensing membrane 12. The dispensing membrane 12 is provided with at least one dispensing opening 15. The closure surface or dispensing membrane 12 has an all-round collar 12*a* which is inverted over the box edge and connected to the latter, for example by means of heat sealing, a press apparatus (not shown) used for this purpose preferably pressing against the collar 12*a* only from the outside for the production of this connection.

A locking lip 12*b* which is not connected to the box cylinder 11*b* but projects away from it and which is preferably formed from the edge region of the collar 12*a* is adjacent to the collar 12*a*, at least in parts, but preferably along the entire circumference.

Inverted over the box end with the dispensing membrane 12 is a lid 13 whose dispensing opening 16 can be made to coincide with the dispensing opening 15 provided in the lid membrane 12 by rotation about the box axis A. The collar 13*a* of the lid 13 overlaps the upper region of the box cylinder 11*b* and the collar 12*a* of the dispensing membrane and has a cardboard ring 13*b* projecting radially inward. This is preferably also connected by means of heat sealing to the inside of the lid collar 13*a* consisting of relatively thin cardboard and imparts to it sufficient strength to prevent any extension. If the lid 13 is now inverted over the dispensing membrane 12, a bead 13*b* applied at the transition from the lid 13 to the lid collar 13*a* possibly being advantageous, the inside of the cardboard ring 13*b* then presses against the outside of the locking lip 12*b*. with the result that said lip comes to rest against the box cylinder 11*a* until the (upper) locking surface 13*c* (on the cardboard ring 13*b*) slides past the (lower) locking surface 12*c* (on the locking lip 12*b*); at this moment, the locking lip 12*b* once again swings elastically outward and the two locking surfaces 12*c*, 13*c* come to rest one on top of the other or interlock.

Figure 4:
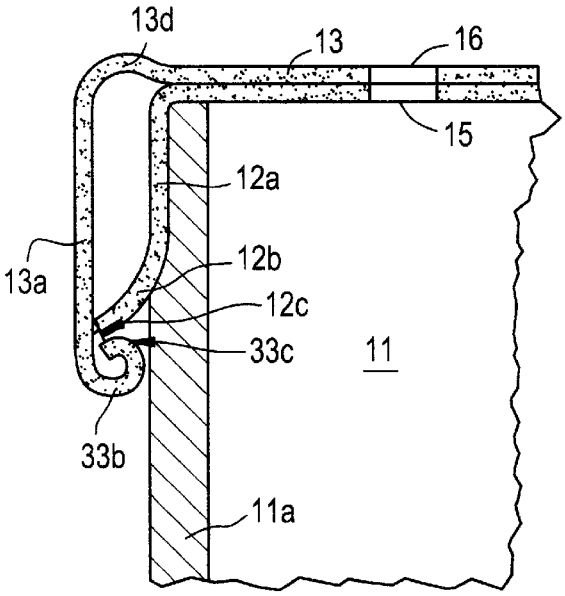

FIG. 4 shows an analogous embodiment, except that, instead of the cardboard ring 13*b* (FIG. 3), the collar 13*a* of the lid 13 ends in a roll ring 33*b* which is flanged inward and forms a locking surface 33*c*.

Figure 5:
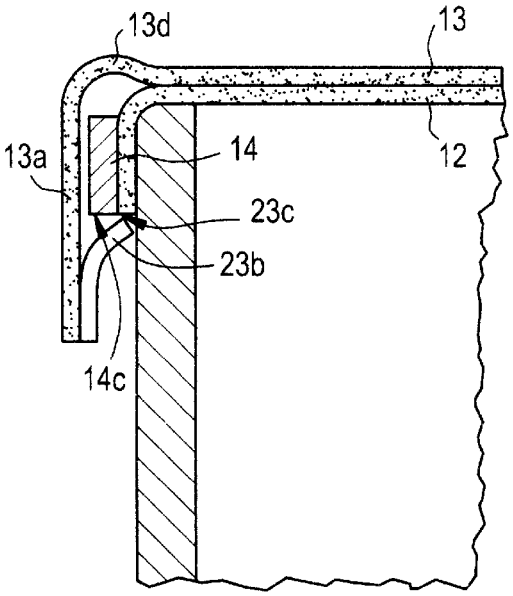

FIG. 5 shows an embodiment in which the locking lip 23*b* is mounted on the inside of the lid collar 13*a*—here it must of course project upward. Here, on the dispensing Membrane 12, instead of a locking lip 12*b*, a cardboard ring 14 is connected to the membrane collar 12*a* on the outside (it could also be on the inside). When the lid 13 is inverted over the dispensing membrane 12, the locking lip 23*b* in this case is pressed by the cardboard ring (or the membrane collar 13*a*) outward against the inside of the lid collar 13*a* and snaps back inward as soon as it has passed the cardboard ring 14.

Figure 6:
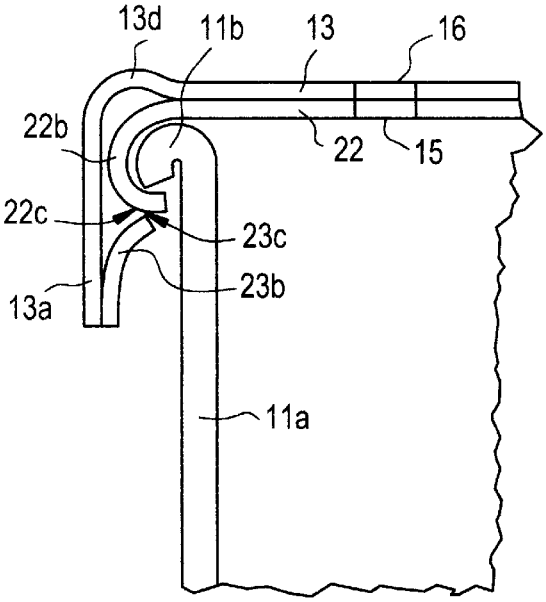

FIG. 6 shows an embodiment analogous to FIG. 5, except that here, instead of the cardboard ring 14, a roll ring 22*b* is provided, said roll ring being formed from an outward-pointing flange of the box cylinder 11*b* with the dispensing membrane 22 and resulting in a locking surface 22*c*.

Figure 7:
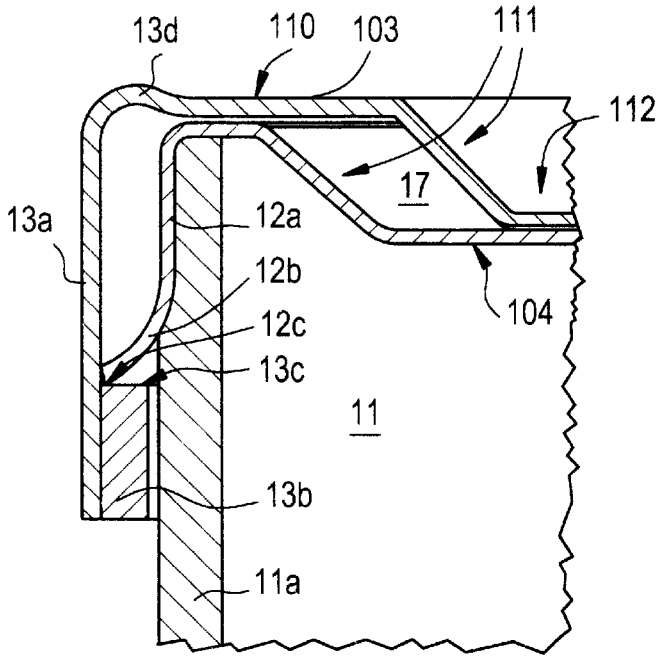
FIGS. 7 and 8 show sections in the axial direction through two different embodiments.
Figure 8:
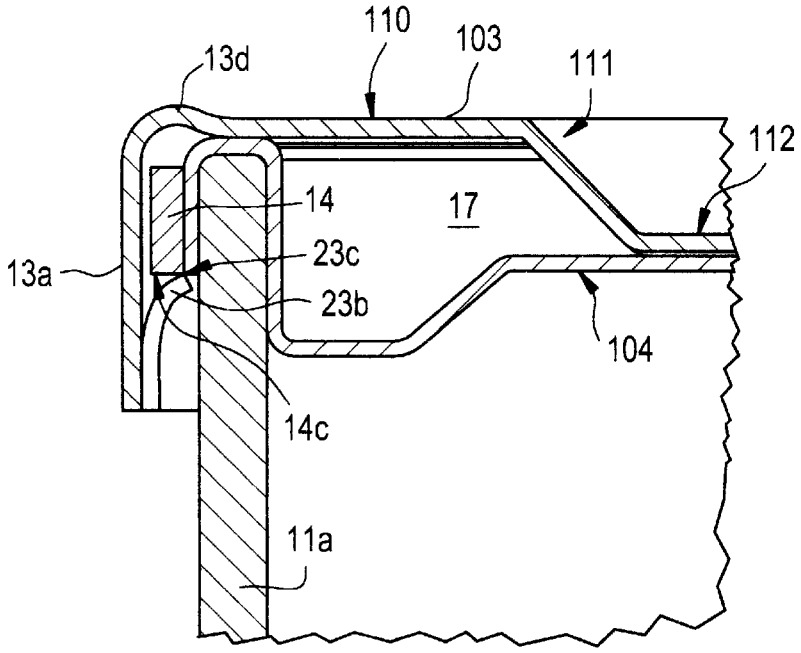

FIGS. 7 and 8 show embodiments in which the closure element 104 and the lid 103 have three-part closure surfaces: The peripheral closure surface 110—at least of he lid—is in a radially outer region and in the end plane of the box. In a central region 112, the closure surfaces are displaced slightly toward the box interior. In a transition region 111, the closure surfaces pass over, with an annular part-surface inclined toward the box axis, from the radial to the central region. The closure surfaces 103,104 acquire increased dimensional stability as a result of the inclined part-surfaces in the transition region 111 before the connection to the box cylinder and, after connection, the transition region 111 together with the central region 112 permits a volume increase in the box without the closure surfaces 103,104 extending beyond the plane of the box closure. Volume changes result when there are changes in the ambient pressure.

In order to provide a pressure equilibration region between the lid 103 and the closure element 104, the closure surfaces are not adjacent to one another in the transition region 111. Accordingly, the transition regions 111 of the lid

103 and of the closure element 104 are arranged in a radially staggered manner. The pressure equilibration region forming a closed cavity 17 facilitates the removal and mounting of the lid 103. It may be advantageous if, according to FIG. 8, the pressure equilibration region is enlarged by arranging the outer region of the closure element 4 not in the plane of the box end but even slightly further in the box interior than the central region 112.

Although the invention is preferably applied to an embodiment of the box as a dispensing box it is by no means limited thereto. Rather, the snap closure used according to the invention could also be used simply for connecting a lid or base which is closed and can be removed only by destruction.

The invention is not limited to the embodiments shown. Although the preferred embodiment was described, in which the locking lip 12*b* is part of the respective collar 12*a* or 13*a*, it is clear that it is also possible to mount two looking lips, both on the inside of the lid collar 13*a* and on the outside of the lid cylinder 11*a*.

I claim:

1. A dispensing box comprising:

a box cylinder arranged around an axis, the cylinder having an outer surface on an outside thereof and a first end closed by:

a) a dispensing membrane having an outer surface and a collar around a circumference of the membrane, the collar being at least partially bonded to the outer surface of the box, and b) a lid having a collar and an inner surface being placed against the outer surface of the dispensing membrane, at least one snap connector connecting the collar and the lid for providing a snap connection between the collar and the lid and holding the lid rotatably around the axis of the box, said snap connector comprising a first projection overlapping the box cylinder on the outside of the box cylinder and a second projection projecting inwardly on an inside portion of the collar of the lid, the snap connector having a snapped-in state in which a locking surface of the first projection rests against a locking surface of the second projection, wherein the dispensing membrane and the lid consist essentially of cardboard, the dispensing membrane having a substantially flat planar surface which is at least partially arranged flush with said first end of the box, and one of the first and second projections comprising a ring member selected from a group consisting of a cardboard ring and a roll ring, said ring member being connected to a structural member selected from, a group consisting of the lid collar and the membrane collar.

2. The box as claimed in claim 1, wherein a wall thickness of the collar is smaller than a radial dimension of said ring member.

3. The box as claimed in claim 1, wherein at least one of the projections extends uninterruptedly over a total circumference of the box or of the collar respectively.

4. The box as claimed in claim 1, wherein the locking lip is formed from an edge of the collar projecting outwardly around a circumference of the box.

5. The box as claimed in claim 1, wherein said locking lip has a smaller thickness than the second projection.

6. The box as claimed in claim 1, wherein the dispensing membrane and the lid each have at least one dispensing opening and wherein each dispensing opening of the membrane is alignable with a corresponding dispensing opening of the lid by a rotation of the lid.

* * * * *